United States Patent [19]

Sudnishnikov et al.

[11] 4,280,573

[45] Jul. 28, 1981

[54] ROCK-BREAKING TOOL FOR PERCUSSIVE-ACTION MACHINES

[76] Inventors: Boris V. Sudnishnikov, Krasny prospekt, 56, kv. 59; Veniamin V. Kamensky, ulitsa Derzhavina, 19, kv. 78; Eduard P. Varnello, ulitsa Dzerzhinskogo, 3, kv. 19; Sergei K. Tupitsyn, ulitsa Zorge, 123, kv. 31; Konstantin K. Tupitsyn, Krasny prospekt, 51, korpus 3, kv. 25, all of Novosibirsk, U.S.S.R.

[21] Appl. No.: 48,252

[22] Filed: Jun. 13, 1979

[51] Int. Cl.[3] ..... E21B 10/48

[52] U.S. Cl. ..... 175/418; 175/404; 175/405

[58] Field of Search ..... 175/59, 60, 387, 401, 175/402, 403–405, 407, 417, 418, 20

[56] References Cited

U.S. PATENT DOCUMENTS

| | | | |
|---|---|---|---|
| 175,672 | 4/1876 | Crump | 175/405 |
| 583,317 | 5/1897 | Wilson | 175/403 X |
| 1,213,652 | 1/1917 | Johnson | 175/405 X |
| 1,505,779 | 8/1924 | Hansen | 175/404 X |
| 1,928,451 | 9/1933 | Hammerberg | 175/404 X |
| 1,932,239 | 10/1933 | Berry | 175/404 X |
| 2,499,282 | 2/1950 | Roberts | 175/401 |
| 2,794,623 | 6/1957 | Stokes | 175/404 X |
| 2,807,443 | 9/1957 | Wyman | 175/404 X |
| 3,094,180 | 6/1963 | Haith | 175/401 |
| 3,955,631 | 5/1976 | Kostylev et al. | 175/387 |

*Primary Examiner*—James A. Leppink
*Assistant Examiner*—Richard E. Favreau
*Attorney, Agent, or Firm*—Fleit & Jacobson

[57] ABSTRACT

A rock-breaking tool for preferable use in self-propelled percussive machines for boring wells, comprising a casing with a pointed portion and an end face. The casing has an annular cutting edge formed by the pointed portion and inner tapered surface thereof. The casing is formed with a cone-shaped chamber open at the end face thereof, oriented toward the bottom of a well being drilled, the internal surface of the chamber intersecting with the conical surface of the annular cutting edge. The casing is also provided with ducts communicating the chamber with the surrounding space.

10 Claims, 7 Drawing Figures

ROCK-BREAKING TOOL FOR PERCUSSIVE-ACTION MACHINES

BACKGROUND OF THE INVENTION

1. Field of the Invention

The invention relates to machines for boring wells in rocks and more particularly to rock-breaking tools of self-propelled percussive-action machines for boring wells.

The present invention can advantageously be employed for boring wells in brittle rock of low toughness, for example, frozen soil of high toughness, coal and others.

The tool according to the invention can be used in mining, construction and wherever it is necessary to bore a deep well in tight quarters, for example, in mines where it is often difficult if not impossible to employ tubular rock-breaking tools, drills and augers with attendant bulky drilling equipment.

2. Description of the Prior Art

There is widely known a rock-breaking tool formed with a hollow cylinder having at one end an anvil block, and at the other end, the one oriented toward the bottom of a well being drilled, an annular cutting edge. Such a tool is termed a drill for making holes in various elements of building structures.

The principle of operation of the above rock-breaking tool consists in that the tool indents itself into an element of a building structure under the action of impacts from a head of a hand hammer or a hammer of a percussive-action machine, forming a core in its cylindrical cavity in the process. When the tool is withdrawn from the hole it drilled, the core is removed from the cylindrical cavity by striking against the cylinder.

However, such a rock-breaking tool is ineffective in boring wells 50 m and more-deep.

This is explained by that boring of deep wells requires a rock-breaking tool of a length equal to the depth of a well being bored.

The great length of the rock-breaking tool increases its weight proportionally. A considerable increase of the weight sharply decreases the impact transfer factor in the "tool-hammer" system at constant operational parameters of the percussive-action machine. A sharp drop in the impact transfer factor in the "tool-hammer" system makes the tool practically incapable of boring a well.

In addition, the great length of the rock-breaking tool adversely affects its service characteristics (transportation, assembly/disassembly, play in pipe connections impairing rigidity, deviations of bored wells and others).

There is also known another rock-breaking tool for percussive-action machines to bore wells in frozen soil (see, for example, the Author's Certificate of the USSR No. 293,312).

This rock-breaking tool is a cylindrical casing carrying on its top end an anvil block, and at the end facing the bottom of a well being drilled, an annular cutting edge, which is formed with intersecting conical surfaces. The casing is formed with a cylindrical chamber for receiving broken rock (core), the chamber communicating with an orifice in a lateral cylindrical wall of the casing for removing the core from the chamber into the space surrounding the casing. The height at which the orifice for removing the core from the casing is located in the wall of the casing is approximately equal to the specified depth of bored wells and ranges between 4 and 6 m. To direct the core from the cavity inside the casing into the orifice in the wall of the casing, the cylindrical part of the cavity contains a curvilinear partition which delimits the cavity in the top portion of the casing so forming a working cavity which faces the well bottom and accommodates the core. The curvilinear partition is intended for changing the direction of the core motion through 90°.

The above rock-breaking tool operates in the manner below.

When the anvil block of the rock-breaking tool receives impact pulses from the hammer of the impact-action machine, the tool indents itself by its annular cutting edge into rock to partly break it off in the zone of the edge. As the tool progressively indents itself into rock, the chamber in the casing gradually fills with the resultant core which advances toward the curvilinear partition and the orifice in the wall of the casing. Once the chamber of the casing is filled with the core, the rock-breaking tool is extracted and placed at a point of drilling the next well. As a new well is bored in the aforesaid manner, broken rock formed in the new well will displace the core from the first well due to translational motion of the rock-breaking tool. When a new well is bored to a previously specified depth, the core from the preceding well is completely displaced by the core from the second well.

Once boring is completed, the tool is tapped transversally, and the core slides out by gravity from the chamber.

All these rock-breaking tools are not suitable for practical use in boring of deep wells in low-tough rock and can be used only in conjunction with bulky equipment, such as diesel hammers. Additionally, they cannot be employed in self-propelled percussive-action machines because the core they cut does not pass through the narrow annulus between the casing of the self-propelled percussive-action machine and the well wall. Moreover, the core simply butts against the well wall when forced out of the casing chamber.

SUMMARY OF THE INVENTION

It is therefore an object of the invention to provide a rock-breaking tool with an annular cutting edge suitable for use in self-propelling percussive-action machines for boring deep wells.

The above and other objects are attained in a rock-breaking tool, preferably intended for a self-propelled percussive-action machine for borting wells, comprising a casing formed with a chamber open at the end face thereof, oriented toward the bottom of a well being drilled, a part of the casing intended for breaking the bottom is pointed and forms an annular cutting edge having an internal conical surface, the casing being provided with ducts communicating the chamber of the casing with the atmosphere and intended for removing rock debris from the chamber of the casing, according to the invention, the casing chamber is formed as a cone whose base is oriented toward the bottom of the well.

The application of the rock-breaking tool according to the invention in a self-propelled percussive-action for boring wells brings down the cost of boring as compared to similar machines.

It is preferable that the casing of the rock-breaking tool according to the invention is formed with the ducts communicating the chamber thereof with the space surrounding the cavity and intended for removing rock debris so that the inlets of the ducts are oriented toward the bottom of the well being bored.

The ducts so constructed lower the resistance to the motion therein of rock debris and so prevent the blocking of the casing chamber and the ducts by rock debris.

It is also advisable, when boring wells in specified rock, to provide the rock-breaking tool with a rock-breaking rod axially arranged inside the chamber of the casing.

The provision of the rock-breaking rod in the tool enables the tool to break up high-toughness inclusions encountered in rock.

The rock-breaking tool can be made so that the external surfaces of the annular cutting edge and the adjoining part of the casing are cylindrical.

Such construction of the rock-breaking tool prevents self-jamming thereof while being withdrawn from the well and ensures a longer service life of the annular cutting edge. It is also advantageous to provide the casing with a toothed crown intended for secondary breaking of rock debris to fragments of a specified size and located outside the casing beyond the outlets of the ducts for removing rock debris.

To raise the boring rate and prevent the rock-breaking tool against jamming by rock debris, it is good practice to provide in the body of the casing with ducts communicating with the chamber in the casing for blowing the bottom of a well being drilled.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

For easy understanding, examples of embodiments of the present invention, illustrated in the appended drawings, are described using a specific narrow terminology. However, it should be borne in mind that each such term covers all equivalent elements operating in a similar manner and employed for performing the same functions.

Figure 1:
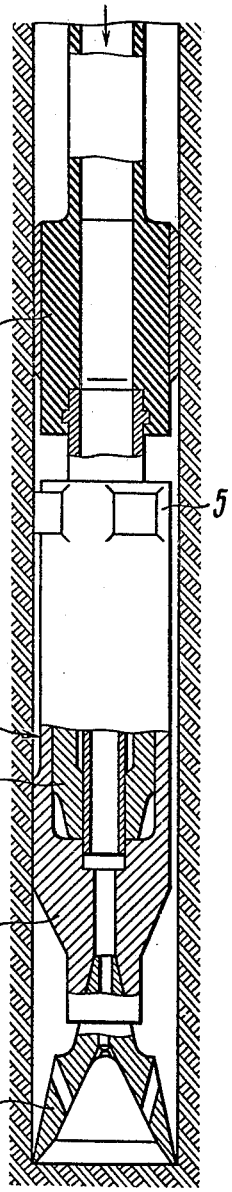
FIG. 1 is a rock-breaking tool, made according to the invention, mounted on a self-propelled percussive-action machine for boring wells, longitudinal view with partial section.

A self-propelled percussive-action machine for boring wells, presented on FIG. 1, has a casing 1 which accommodates a hammer 2 designed for reciprocating movement and transmitting impact pulses to a front part 3 of the casing 1, whereon a rock-breaking tool 4 is mounted. A back part 5 of the casing 1 carries a device 6 designed for radial yielding to prevent the machine moving away from the bottom when a well is being bored. The rock-breaking tool 4 can be mounted in the front part of the casing for axial movement so that the hammer 2 will simultaneously strike against the end face of the tool 4 and the front part 3 of the casing 1.

Figure 2:
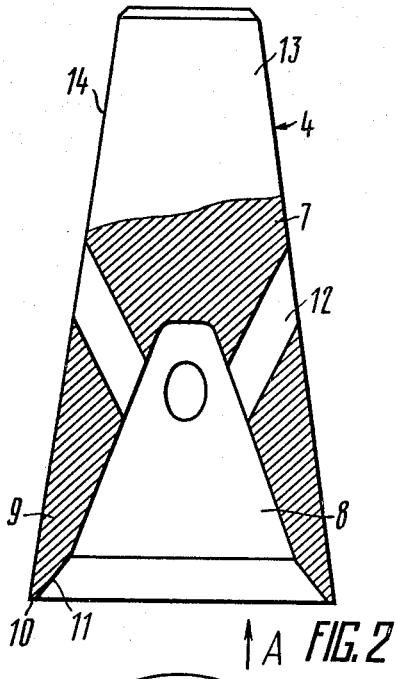
FIG. 2 is longitudinal view with partial section of a rock-breaking tool, according to the invention.

The rock-breaking tool, shown in FIG. 2 and denoted in the general view on FIG. 1 as item 4, has a casing 7 formed with a chamber 8 open at the end face of the casing 7 and oriented toward the bottom of a well being bored. A part 9 of the casing 7, intended for breaking up the well bottom, is pointed and forms an annular cutting edge 10 (FIG. 3) with an internal conical surface 11 (FIG. 2). In addition, the casing 7 is provided with at least two ducts 12 for a forced displacement of fragmented rock from cavity 8 into the space surrounding the casing 7. The chamber 8 is formed as a cone with a rounded-off top whose base is presented to the bottom of a well being drilled. A top part of the casing 7 has a seating cone 14 which is inserted into the front part 3 of the self-propelled percussive-action machine (FIG. 1) when the tool 4 is put into operation.

OPERATION

The above rock-breaking tool 4 operates in conjunction with the self-propelled percussive-action machine in the manner below.

Compressed air supplied to the self-propelled percussive-action machine causes the hammer 2 (FIG. 1) to reciprocate in the casing 1 and strike against the front part 3 of the casing 1 or directly against the rock-breaking tool 4 and the front part 3 of the casing 1.

The impact pulses transferred by the hammer 2 to the tool 4 will force the annular cutting edge 10 thereof to indent itself into rock. As the annular cutting edge 10 has an internal conical surface 11, the rock being broken will be subject to a complicated state of stresses due to compression and shearing deformation.

Indentation of the annular cutting edge 10 to a specified depth results in breakage of the whole section of the well bottom area.

Broken rock is composed of particles of various sizes which are forced (for example, by jets of air or a water-air mixture) out of the chamber 8 in the casing 7 through the ducts 12 into the space surrounding the casing 7. First to be removed from the chamber 8 are the smallest grains of rock debris and particles whose maximum cross sectional dimensions are less than the diameter of the ducts 12. As the rock-breaking tool 4 penetrates into rock, coarser particles accumulate in the chamber 8 until it is full. As the rock-breaking tool 4 reciprocates in the well in the process of boring, the coarser particles interact with one another and the conical surface of the chamber 8 to disintegrate to smaller fragments, which are capable of passing through the ducts 12. This marks the onset of steady-state boring conditions.

The introduction of the rock-breaking tool according to the invention in conjunction with a self-propelled percussive-action machine made possible boring of deep wells in low-tough rock. Particularly effective is the boring of rock by the above tool in restricted areas, for example, in a mine for working thin seams where the use of bulky vibration hammers, equipped with heavy and large-size rock-breaking tools may prove to be impossible.

It is advantageous to provide the rock-breaking tool 4 with the ducts 12 whose outlets are presented to the bottom of a well being bored.

This arrangement of the ducts 12 accelerates the removal of rock debris from the cavity 8 because of a lesser resistance to the motion of these particles along the path "chamber 8—ducts 12".

Figure 4:
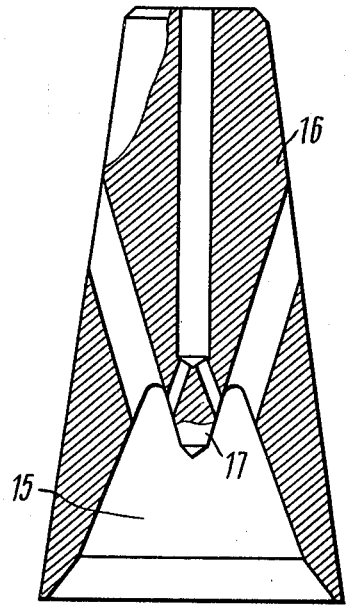
FIG. 4 is a rock-breaking tool of a self-propelled percussive-action machine incorporating a rock-breaking rod inside the chamber of the casing.
Figure 3:
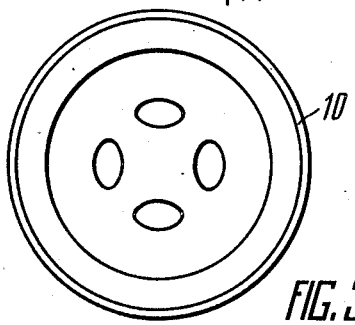
FIG. 3 is a view along arrow "A" on FIG. 2.

FIG. 4 illustrates an alternative embodiment of the rock-breaking tool generally denoted as item 4 on FIG. 1, which differs from the tool shown on FIGS. 2 and 3 in that a chamber 15 of a casing 16 accommodates an axially located therein rock-breaking rod 17. The rod 17 can be offset either forward or backward with respect to the end face of the casing 16, presented to the bottom of a well being bored.

The operation of such a rock-breaking tool differs from that of the tool shown on FIGS. 2 and 3 in that the rock-breaking rod 17 crushes, when offset backward, large particles of inclusions of higher toughness with respect to the main rock which is bored.

Offsetting the rock-breaking rod 17 protects the rock-breaking tool 4 from damage by impact against inclusions of high toughness and of dimensions exceeding the diameter of the tool 4.

Figure 5:
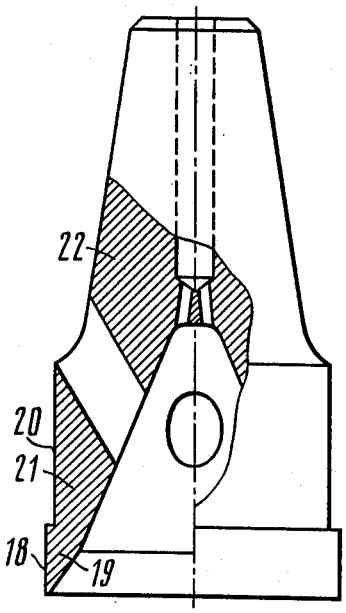
FIG. 5 is a rock-breaking tool wherein the external surface of the annular cutting edge and of the external surface of the adjoining part of the casing are cylindrical.

FIG. 5 presents another alternative embodiment of the rock-breaking tool 4 which differs from the tool shown on FIG. 2 in that an external surface 18 of an annular cutting edge 19 and an external surface 20 of an adjoining part 21 of a casing 22 are cylindrical and extend to outlets in a direction away from the bottom of a well being drilled.

Such construction of the rock-breaking tool protects it against blocking in the well on extraction of the machine with the tool from this well. In addition, this embodiment of the tool sharply increases the resistance thereof to wear and decreases the gauge loss of the annular cutting edge.

The rock-breaking tool according to the invention can be manufactured in a number of alternatives.

Figure 6:
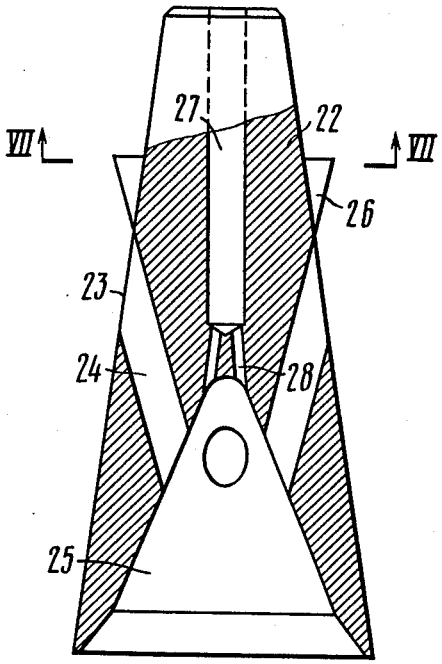
FIG. 6 is a rock-breaking tool provided with a toothed crown outside the casing.
Figure 7:
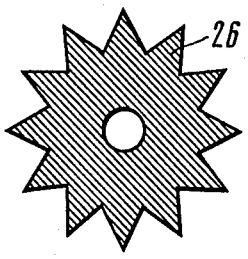
FIG. 7 is a section on line VII—VII of FIG. 6.

FIG. 6 illustrates a rock-breaking tool 4 which differs from the ones previously described in that a toothed crown 26, preferably a conical one, is provided outside the casing 22 back of orifices 23 of ducts 24 for removing fragmented rock from cavity 25.

Such a tool operates on the main similarly to the previously described embodiments. A distinguishing feature in the operation of a tool equipped with a toothed crown is that coarse particles of broken rock, discharged from the ducts 24, enter a so-called "annular wedge" formed with the wall of a well being bored and the conical toothed crown and are ground therein to a specified size.

The use of such a rock-breaking tool for boring wells in conjunction with a self-propelling percussive-action machine prevents clogging of the annular space between the casing of the machine and the wall of a well being drilled and thus avoids the blocking of the tool in the well.

It is useful to provide all the alternative embodiments of the rock-breaking tool 4 with a centrally located duct 27 and ducts 28 in the body of the casing of the tool (FIG. 6) for supplying compressed air or an air-water mixture to the bottom of a well being drilled and so ensuring a highly effective blowing and removal of rock debris. The ducts 28 for blowing the well bottom can best be arranged in between the ducts 24 for removing fragmented rock away from the bottom.

What is claimed is:

1. A rock breaking tool for use with a self-propelled percussive action boring machine comprising a casing having a rear end portion for attachment to the machine and a hollow forward end portion terminating in a continuous annular cutting edge, said forward end portion including a first internal frusto-conical surface defining said cutting edge, a second internal frusto-conical surface extending rearwardly and inwardly from said first frusto conical surface, said second surface defining an internal rock-collecting chamber and at least one duct in said forward end portion connecting said chamber with the exterior of the casing, said duct having an opening in said second surface and said duct extending outwardly and rearwardly from said opening.

2. A rock breaking tool as claimed in claim 1 wherein said casing has outer cylindrical surfaces defining said cutting edge and said chamber, respectively.

3. A rock breaking tool as claimed in claim 1 wherein said casing has an outer surface formed with a toothed crown rearwardly of where said at least one duct opens into said outer surface.

4. A rock breaking tool as claimed in claim 1 including a rock breaking rod located axially in said chamber.

5. A rocking breaking tool as claimed in claim 1 or claim 4 including additional duct means communicating with said chamber for delivering air under pressure thereto.

6. In a percussive action boring machine including a housing and a reciprocating hammer for transmitting impact pulses to said housing, the improvement comprising a rock breaking tool mounted on a forward end of said housing for receiving impact pulses from said hammer, said tool including a casing having a rear end portion attached to said housing and a hollow forward end portion terminating in a continuous annular cutting edge, said forward end portion including a first internal frusto-conical surface defining said cutting edge, a second internal frusto-conical surface extending rearwardly and inwardly from said first frusto-conical surface, said second surface defining an internal rock collecting chamber and at least one duct in said forward end portion connecting said chamber with the exterior of said casing, said duct having an opening in said second surface and said duct extending outwardly and rearwardly from said opening.

7. The improvement as defined in claim 6 wherein said tool includes a rock breaking rod located axially in said chamber.

8. The improvement as defined in claim 6 wherein said casing has outer cylindrical surfaces defining said cutting edge and said chamber, respectively.

9. The improvement as defined in claim 6 wherein said casing has an outer surface forward with a toothed crown rearwardly of where said at least one duct opens into said outer surface.

10. The improvement as defined in claim 6 including additional duct means communicating with said chamber for delivering air under pressure thereto.

* * * * *